US005743204A

United States Patent [19]

Tweet

[11] Patent Number: 5,743,204

[45] Date of Patent: Apr. 28, 1998

[54] EDGE TRIM FOR WATERCRAFT

[75] Inventor: Ole Tweet, Thief River Falls, Minn.

[73] Assignee: Arctic Cat Inc., Thief River Falls, Minn.

[21] Appl. No.: 705,310

[22] Filed: Aug. 29, 1996

[51] Int. Cl.[6] ..... B63B 19/00

[52] U.S. Cl. ..... 114/219; 114/219

[58] Field of Search ..... 114/219; 405/212, 405/215; 267/139, 140; 293/102, 128, 140; 280/770

[56] References Cited

U.S. PATENT DOCUMENTS 2,910,033 10/1959 Weisburg ..... 114/219

*Primary Examiner*—Stephen Avila

*Attorney, Agent, or Firm*—Merchant, Gould, Smith, Edell, Welter & Schmidt, P.A.

[57] ABSTRACT

An edge trim piece for sealing the junction between top and bottom hull members of a watercraft includes a main body having a first end for engaging the top hull member, a second end for engaging the bottom hull member and a bridging section between the first and second ends for overlying the junction between the hull members. The edge trim piece has a sealing cover for the bridging section that has a first end secured to the first end of the main body and a second end that extends in the direction of but is not secured to the second end of the main body.

11 Claims, 3 Drawing Sheets

EDGE TRIM FOR WATERCRAFT

BACKGROUND OF THE INVENTION

The present invention is directed to an edge trim useful for watercraft. More particularly, the edge trim is used with watercraft that have top (deck) and bottom (hull) members to cover the area of junction between the two members. The edge trim of the present invention is particularly useful for water jet-propelled personal watercraft such as those sold under the TIGERSHARK® trademark by Arctco, Inc. of Thief River Falls, Minn.

A typical two-piece edge trim member of the prior art is illustrated in FIG. 1. It can be seen that this edge piece 10 spans the area of junction between the top member 12 and bottom member 14, for example, for a water jet-propelled personal watercraft. The edge trim piece 10 is held in place by fasteners 16, which extend through the edge trim piece and into the top and bottom members. The edge trim piece is provided with an open channel to allow access to the fasteners to secure the edge trim piece to the watercraft. After installation, the channel 18 is closed with a sealing piece 20, which is configured to engage the walls of the channel.

However, this arrangement has caused some difficulties. The sealing piece 20 has tended to expand and contract at a different rate than the piece that is secured to the watercraft. This has resulted in a tendency of the piece 20 to disengage from the walls of channel 18. A similar result has been observed due to the normal stresses to which the trim piece is subjected during use. Moreover, the multi-piece construction increases the cost associated with production and installation of the edge trim piece.

SUMMARY OF THE INVENTION

The present invention overcomes the disadvantages of the previous constructions by providing a one-piece edge trim piece that is easily installed and provides reliable sealing characteristics and appealing aesthetic values.

DETAILED DESCRIPTION

The present invention provides an edge trim piece useful for covering the area of joinder between the top and bottom members of a watercraft. The trim piece will, in use, extend essentially around the periphery of the watercraft along the junction of the top and bottom members. While the edge trim piece of the present invention is particularly useful for jet-propelled personal watercraft, the present invention will find use in a wide variety of watercraft.

Figure 1:
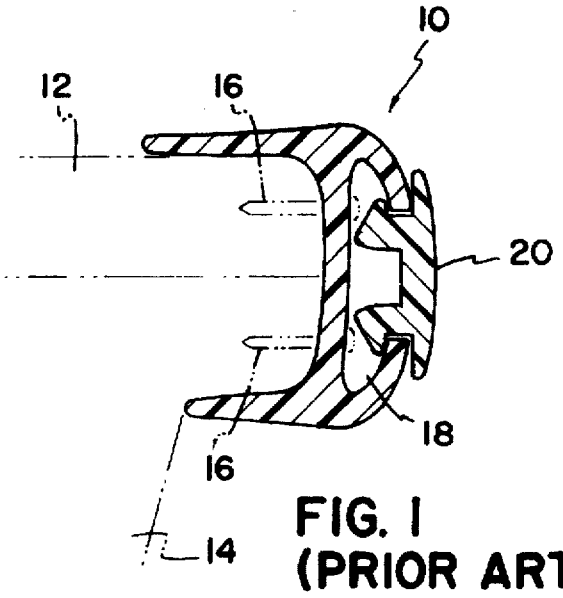
FIG. 1 (PRIOR ART)
FIG. 1 is a cross-sectional view of a two-piece prior art edge trim piece.
Figure 2:
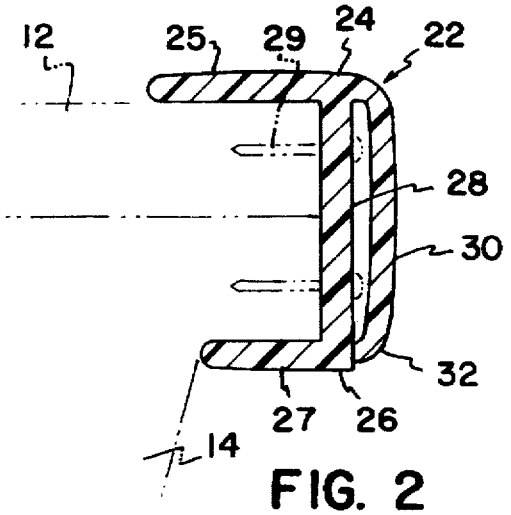
FIG. 2 is a cross-sectional view of one embodiment of an edge trim piece of the present invention.

Referring to FIG. 2, edge trim piece 22 illustrates a first embodiment of the present invention. The edge trim piece is illustrated in use with a watercraft having top and bottom members 12 and 14 that abut each other in a non-overlapping relationship in the area of joinder between the two members. This edge trim piece includes a first end 24 that is to be associated with the top member 12 of the watercraft, and a second end 26 that is to be associated with the bottom member of the watercraft, and covers the bottom of the joint. A bridging section 28 extends across the junction between the two members. The first and second ends may include flanges 25 and 27, which extend in the direction away from the cover 30 of the trim piece. The size and shape of the flanges can be changed as desired, and the flanges can be omitted if desired.

The edge trim piece 22 is secured to the watercraft with fasteners 29 that extend through the edge trim piece and into the edges of the top and bottom members of the watercraft. Any suitable fasteners can be used, such as screws, rivets, staples, etc. It is preferred that the fasteners extend through the edge trim piece in the area of the bridging section 28.

A sealing cover 30 is provided to conceal and protect the bridging section and fasteners. The cover 30 in the embodiment of FIG. 2 has a first end that is secured to and integral with the first end of the main body of the trim piece and a second end that extends toward but is not necessarily secured to the area of the second end of the main body of the trim piece. It is preferred that the cover be separated from the main body, except at the first end of the main body. It should be understood that the spacing between the bridging section and the cover can be very small, even as small as the spacing that would result if the cover was formed by slitting the main body with a cutting blade, and that contact between the cover and the bridging section can be tolerated. In the embodiment of FIG. 2, the sealing cover 30 has a lip 32 at its second end that protrudes in the direction of the second end of the main body.

The edge trim piece of the present invention can be installed on a watercraft by applying the edge trim piece to the periphery of the assembled top and bottom members along the junction between the two members. The sealing cover 30 is deflected away from the main body of the edge trim piece so as to expose the bridging section 28. The fasteners 29 can then be passed through the bridging section and into one or more of the top and bottom members.

The installation is facilitated if the edge trim piece is made of a suitable thermoplastic material such as polyvinyl chloride. In such a case, it possible to heat the edge trim piece as part of the installation process, so that the edge trim piece can be deformed more easily to follow the periphery of the watercraft. In addition, the deflection of the sealing cover is facilitated by heating when the edge trim piece is made of a thermoplastic material. The heating should be conducted only sufficiently to make the thermoplastic material more pliable, and not enough to cause any significant melting or softening. If desired, the second end of the sealing cover could be sealed to the main body after installation of the edge trim piece.

The exterior surfaces, for example, the outer surfaces of the flanges and the sealing cover, can be provided with a matte finish or a gloss finish to provide a desired aesthetic effect. In addition, the composition used for the edge trim piece can be provided with dyes or pigments to provide a desired color, and also can include the usual additives such as antioxidants to provide improved performance.

Figure 3:
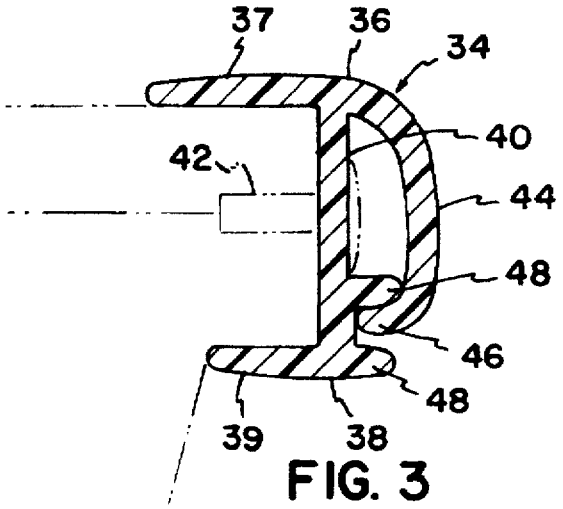
FIG. 3 is a cross-sectional view of a second embodiment of an edge trim piece of the present invention.

A second embodiment 34 of the edge trim piece of the present invention is illustrated in FIG. 3. The edge piece of this embodiment includes a first end 36 and second end 38, with associated respective flanges 37 and 39. These features are similar to those discussed with respect to the embodiment of FIG. 2. This embodiment likewise includes a bridging section 40. In this embodiment, the fastener 42 is a rivet that engages both of the members of the watercraft.

The edge trim piece of this embodiment includes a sealing cover 44 that has a first end secured to the first end of the main body of the trim piece. The second end extends toward the second end of the main body and includes a lip 46. In the second embodiment, the second end of the main body is provided with a pair of longitudinal channel members 48 that define a channel into which the lip 46 extends. This configuration is advantageous in providing an improved sealing effect. Like the edge trim piece of FIG. 2, the edge trim piece of FIG. 3 can be produced by extruding a suitable thermoplastic material such as polyvinyl chloride through an appropriate mold.

Figure 4:
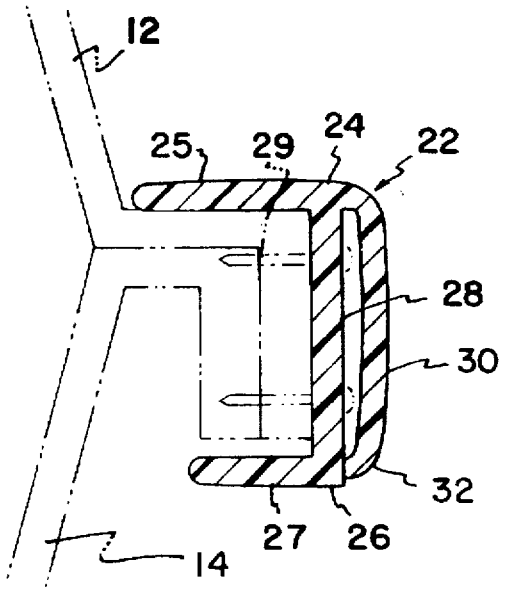
FIG. 4 is a cross-sectional view of the embodiment of FIG. 2, used with a different type of joint.
Figure 5:
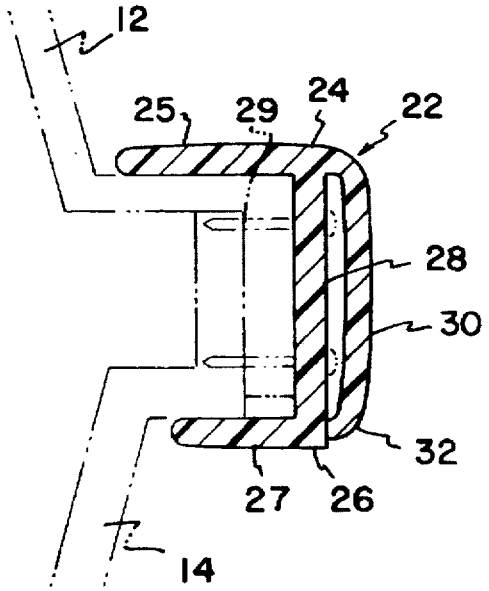
FIG. 5 is a cross-sectional view of the embodiment of FIG. 2, used with a different type of joint.

FIGS. 4 and 5 illustrate the embodiment of FIG. 2, as applied to watercraft having different systems for joining the top and bottom members together. It should be understood that the embodiment of FIG. 3 also could be used with the watercraft illustrated in these figures.

In FIG. 4, the top member 12 and bottom member 14 define a downwardly-extending lip in the area of joinder, with the top member being disposed outwardly of the bottom member. If desired, an upwardly-extending lip with the bottom member on the outside could be used, but the illustrated embodiment is believed to be more practical and thus is preferred. In this case, both the first end of the main body and the bridging section are in contact with the top member. The flange 27 of the second end of the main body extends below the lip, and can be in contact with the bottom of the lip if desired. While fasteners 29 are illustrated as extending through the top member 12 and into bottom member 14, it will be appreciated that the fasteners can be short enough that they do not reach the bottom member if desired.

In FIG. 5, the top and bottom members are in an overlapping relationship in the area of joinder. In the illustrated embodiment, the top member is disposed outwardly of the bottom member, although this could be reversed if desired. In FIG. 5, the first end of the main body of the edge trim piece and the bridging section contact the top member, while the second end of the main body extends below the area of joinder. If desired, the flange 27 of the second end can be in contact with the bottom member in the area of joinder.

Figure 6:
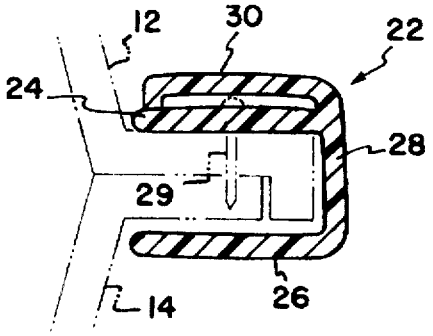
FIGS. 6–8 are cross-sectional views of further embodiments of the present invention.
Figure 7:
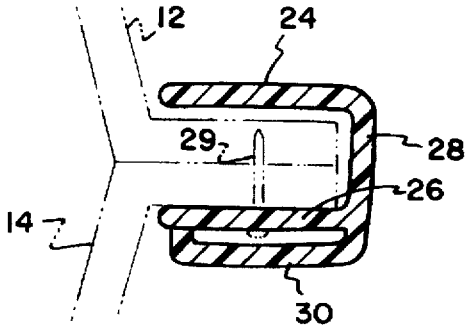
Figure 8:
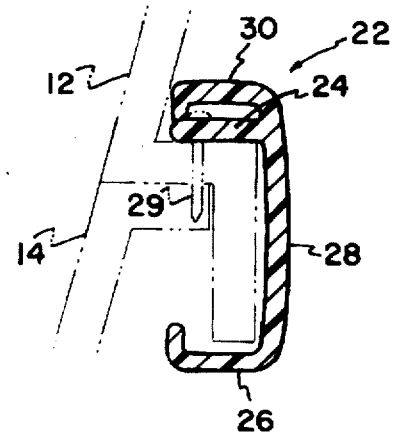

FIGS. 6–8 show further embodiments of the edge trim piece. In the embodiments of FIGS. 2–5, it can be seen that the fasteners extend through the bridging section of the main body. It also is possible to adapt the present invention to the situation in which the fasteners extend through one of the end sections of the main body, and this is illustrated with various forms of joints in FIGS. 6–8. It should be noted that the embodiment of FIG. 8 is particularly desirable in that the second end wraps around the edge of the top member, thereby providing for a more comfortable grip for the user when the watercraft is being lifted. The trim pieces illustrated in FIGS. 2–6 are similar to that of FIG. 2. However, other configurations, such as that of FIG. 3 could be adapted in a similar manner.

While a detailed description of the present invention has been provided above, the invention is not limited thereto and modification not departing from the spirit and scope of the invention will be apparent to those skilled in the art. The invention is defined in the following claims.

What is claimed is:

1. A watercraft, comprising:

a top member;

a bottom member joined to the top member; and an edge trim piece for covering the area of joinder between the top and bottom members, the edge trim piece comprising:

a main body having a first end associated with a portion of the top member in the area of joinder between the top and bottom members, a second end associated with a portion of the bottom member in the area of joinder between the top and bottom members, and a bridging section disposed between the first and second ends; and a cover for the bridging section having a first end that is secured to the area of the first end of the main body and a second end that extends toward the area of the second end of the main body, wherein the second end of the cover is held in contact with the area of the second end of the main body by the resilience of the cover, but is not secured to said area.

2. The watercraft of claim 1, wherein the edge trim piece is secured to at least one of the top member and the bottom member with a plurality of fastening members that extend through the bridging section.

3. The watercraft of claim 1, wherein the cover of the edge trim piece is spaced from the bridging section between the first and second ends of the cover.

4. The watercraft of claim 1, wherein the second end of the cover of the edge trim piece comprises a lip protruding in the direction of the second end of the main body.

5. The watercraft of claim 4, wherein the main body of the edge trim piece further comprises a pair of channel members extending outwardly from the main body and defining a channel therebetween, the lip of the cover extending into the channel.

6. The watercraft of claim 1, wherein the first end of the main body further comprises a first flange extending away from the cover, and the second end of the main body further comprises a second flange extending away from the cover.

7. The watercraft of claim 1, which is a water jet-propelled personal watercraft.

8. The watercraft of claim 1, wherein the top and bottom members are in an abutting relationship in the area of joinder with a seam defined therebetween, and the first end of the main body of the edge trim piece contacts the top member of the watercraft, the second end of the main body of the edge trim piece contacts the bottom member of the watercraft and the bridging section overlies the seam.

9. The watercraft of claim 1, wherein the top and bottom members are in an overlapping relationship in the area of joinder, and the first end of the main body of the edge trim piece contacts the top member of the watercraft and the second end of the main body of the edge trim piece contacts the bottom member of the watercraft.

10. The watercraft of claim 1, wherein the top and bottom members form a downwardly-extending lip in the area of joinder with the top member being disposed outward of the bottom member, and the first end of the main body of the edge trim piece and the bridging section contact the top member in the area of the downwardly-extending lip.

11. A watercraft, comprising:

a top member;

a bottom member joined to the top member; and an edge trim piece for covering the area of joinder between the top and bottom members, the edge trim piece comprising:

a main body having first and second ends and a bridging section disposed between the first and second ends;

a fastener for securing the edge trim piece to a watercraft, extending through the main body; and a cover having a first end that is secured to the main body and a second end, the cover extending over the fastener, wherein the second end of the cover is held in contact with the area of the second end of the main body by the resilience of the cover, hut is not secured to said area.

* * * * *